US008670860B2

(12) United States Patent
Gifford

(10) Patent No.: US 8,670,860 B2
(45) Date of Patent: Mar. 11, 2014

(54) BAG TOP REGISTRATION APPARATUS

(75) Inventor: Jon W. Gifford, Champin, MN (US)

(73) Assignee: Thiele Technologies, Inc., Minneapolis, MN (US)

( * ) Notice: Subject to any disclaimer, the term of this patent is extended or adjusted under 35 U.S.C. 154(b) by 1137 days.

(21) Appl. No.: 12/589,860

(22) Filed: Oct. 29, 2009

(65) Prior Publication Data

US 2011/0106297 A1 May 5, 2011

(51) Int. Cl.
*G06F 7/00* (2006.01)

(52) U.S. Cl.
USPC ..... 700/218

(58) Field of Classification Search
USPC ..... 700/218; 53/570, 284.7, 386.1, 571
See application file for complete search history.

(56) References Cited

U.S. PATENT DOCUMENTS 3,673,759 A * 7/1972 Ayres et al. ..... 53/459
4,078,358 A * 3/1978 Henderson ..... 53/459
4,561,238 A * 12/1985 Odom ..... 53/573
5,452,567 A 9/1995 Lieder
5,957,172 A * 9/1999 DeGreef et al. ..... 141/166

* cited by examiner

*Primary Examiner* — Ramya Burgess
(74) *Attorney, Agent, or Firm* — Wood, Phillips, Katz, Clark & Mortimer

(57) ABSTRACT

Bag top registration apparatus includes infeed mechanism that feeds bags, which may be of different lengths, from a magazine to positioner assemblies which have back lights and bag clamps that are operable for moving the bags, if necessary, to have their bag top edges over the back lights at registration positions and pick-up mechanism for transferring the bags at registration positions to a conveyor assembly with their top edges at the same elevation. Cameras take images of the bags on the positioner assemblies extending in part over the back lights. The programmable logic controller in comparing the images with the parameters imparted by a human machine interface controls the operation of the clamps to move the bags to the registration positions and the mechanism for removing the bags from the magazine, the clamps, the pick-up mechanism and the conveyor assembly.

7 Claims, 19 Drawing Sheets

BAG TOP REGISTRATION APPARATUS

BACKGROUND OF THE INVENTION

This invention relates apparatus for feeding flat folded bag to a filling station with their open ends at the same elevation even though at least some of the folded bags on a magazine are of different heights (dimension from the bag bottom to the bag mouth edge.

At the present, there is apparatus that can be adjusted for feeding one batch of bags on the magazine to a feeding station, however this requires an adjustment by an operator when feeding another batch of bags to a filling station when the second batch is of a different length than the first batch. Further, problems have encounter when one or more of the bags in a batch are of different lengths from others.

In order to provide apparatus that automatically make adjustments in feeding bags from magazine wherein at least some of the bags in a stack are of different lengths to have their bag top edges at the same elevation for carrying out operations, for example filling the bags and closing the bag mouths after being filled.

SUMMARY OF THE INVENTION

The bag top registration apparatus includes an infeed assembly for removing two bags at a time from a tandem bag magazine and feeding them to adjacent positioner trays assembly where bag bottom clamp the bags received from the infeed assembly. The positioner tray assemblies having back lights that are at least partially covered by the bag top portions, there being cameras that through a programmable logic controller controls the movement of the bag bottom clamps to move the bags to have the bag top edges at a preselected elevation when subsequently moved to carry out operations, for example closing filled bags. Then the clamped bags are released and a pick-up assembly moves the clamped bags to conveyor mechanism to be conveyed for further operations with the bag top edges at the same elevation even though bags of different lengths were picked up from the magazine mechanism.

An object of this invention is to provide new and novel means for removing bags from magazine mechanism and automatically positioning bags, even of different lengths to have their bag top edges at the same elevation when moved by a conveyor assembly for further operations, for example filling bags. A further object of this invention is to provide new and novel apparatus to automatically sense the lengths of bags that are mechanically removed from a magazine and automatically position the bags to have their bag top edges at the same elevation, even if the bags on a magazine are of different lengths, before the bags are conveyed to a station for further operations.

DESCRIPTION OF THE PREFERRED EMBODIMENT

Figure 1A:
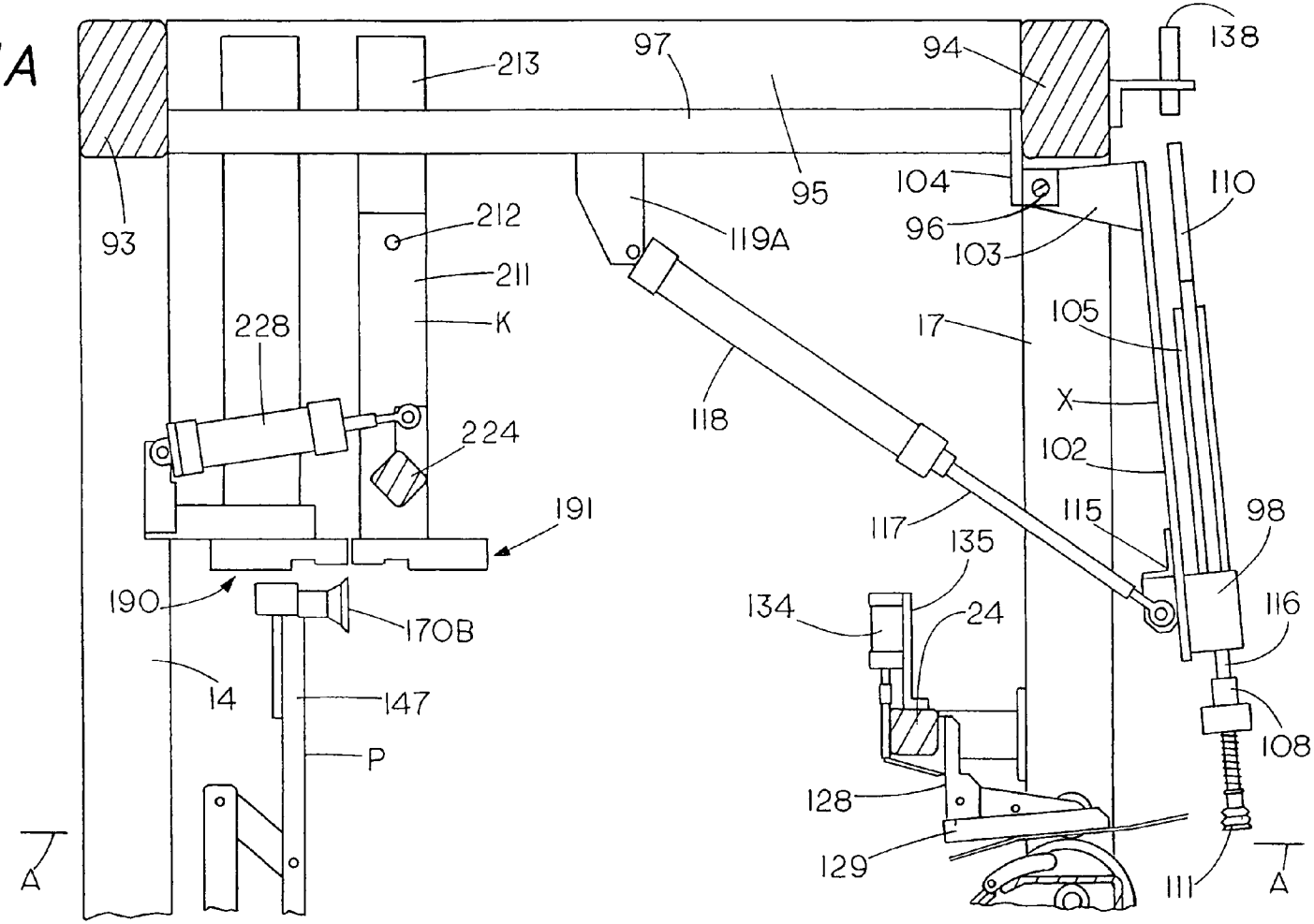
FIGS. 1A and 1B with lines A-A and B-B aligned is a transverse cross sectional that is generally taken along the line and in the direction of the arrows 1A, 1B of FIG. 10 without the bag clamps being shown and the longitudinal actuator being shown in cross section, greater details of some of the structure being shown in one or more of the other Figures.
Figure 1B:
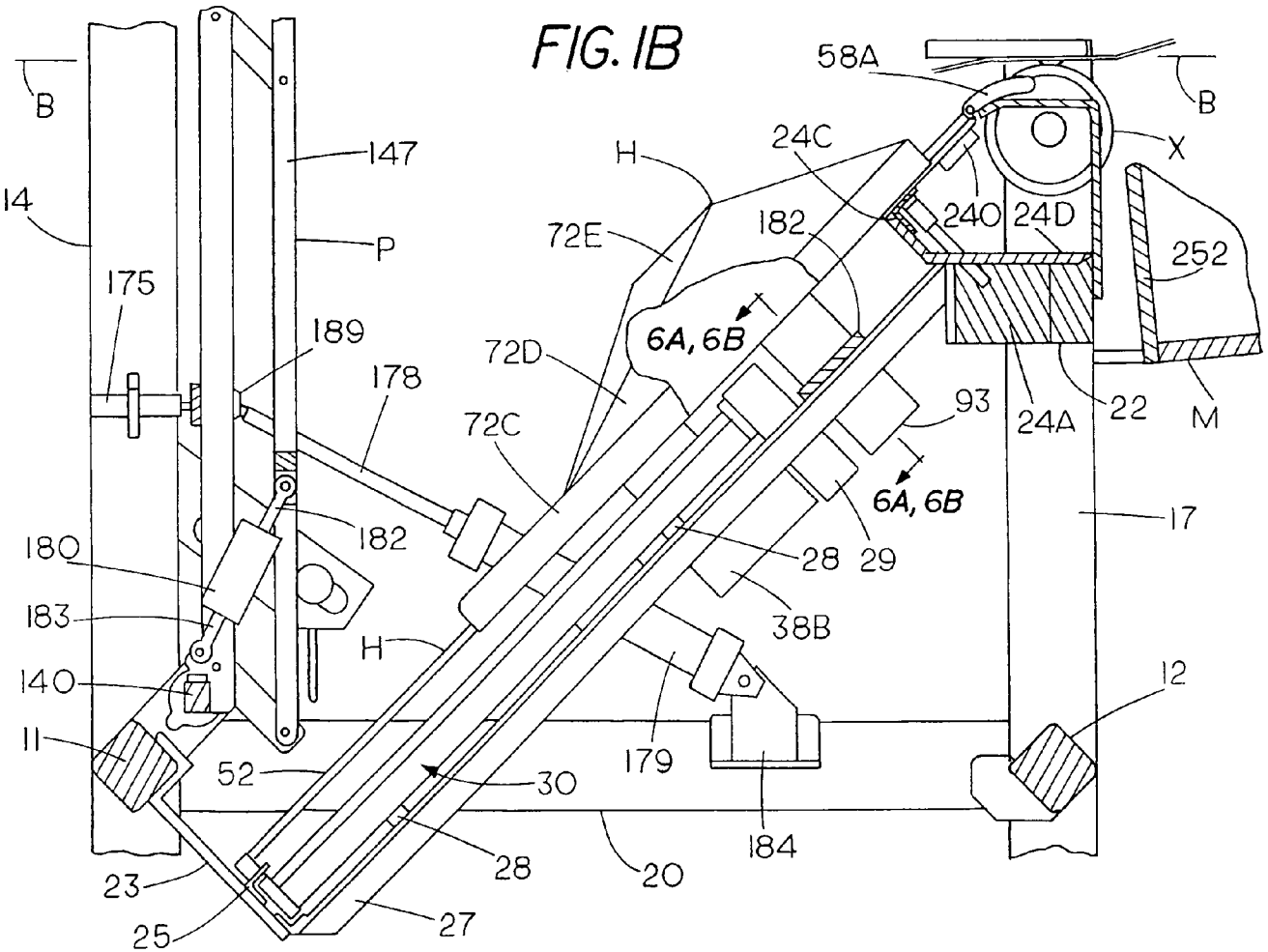
Figure 14:
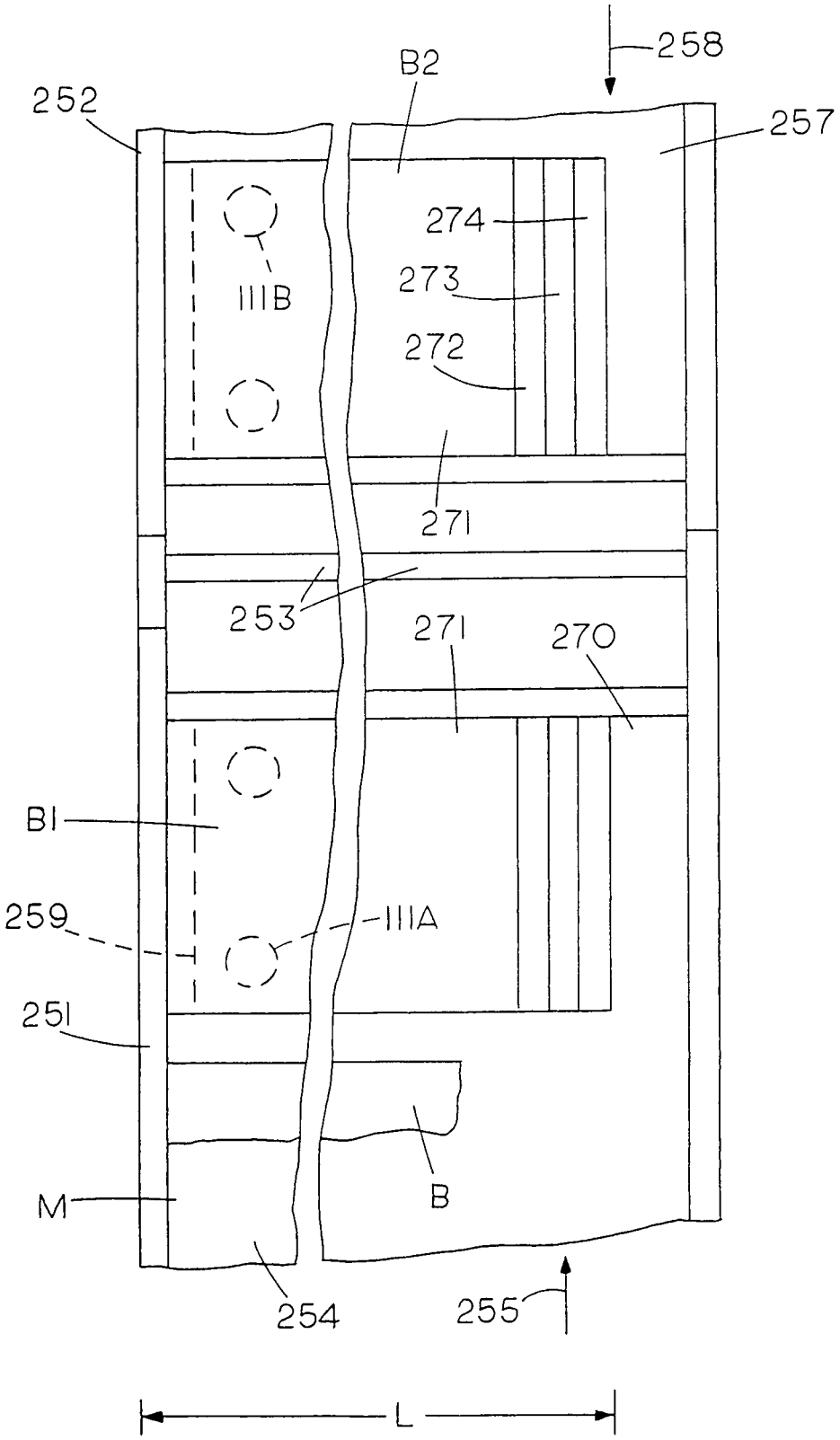
FIG. 14 is a diagrammatically plan view of part of the tandem magazine mechanism with the positions that the infeed vacuum cups engage the top bags of stacks of bags on the convey belts of the magazine mechanism being shown in dotted lines.

Referring to the drawings, and in particular to FIGS. 1A, 1B and 14, there is shown an infeed assembly X for picking up two bags 271 from stacks B1, B2 at substantially the same time from tandem magazine mechanism M and feeding them to tray positioner assemblies H, G. After the two bags have been automatically moved on the tray assemblies to have their bag top edges at preselected positions on the tray assemblies, a pick-up assembly P removes the bags from the tray assemblies and moves them to a conveyor assembly K to be conveyed for further operations.

Referring to FIGS. 1B and 2-4, the frame includes bottom longitudinal frame members 11, 12 extending between vertical frame member 13, 14 and 15, 17 respectively, a bottom transverse frame member 20 extended between vertical frame member 14, 17 and an intermediate longitudinal frame member 22 extending between frame members 15 17. Each tray positioner assembly G, H includes a lower support bracket 23 that is mounted to the frame member 11 which are in longitudinally spaced relationship while an upper angle bracket mechanism 24A is mounted to the frame member 22. Each positioner tray assembly includes a pair of longitudinally spaced angle irons 27 that at their one ends are mounted to the bracket 23 while their transverse opposite ends are mounted to the bracket 24A to be inclined upwardly from the bracket 23 at an angle that advantageously is about 45 degrees. A longitudinal elongated bent plate 24D is mounted to the bracket mechanism 24A and in turn mounts a longitudinally elongated angle iron to extend beneath the upper end portions of position tray assemblies. Mounted to the angle iron 24C to be in transverse alignment with each of the feed roller 125A, 125B is a cylinder mount 77 which slideably mounts a shock absorbing cylinder device 78 to extend through the bent plate 24D and abut against the center rod 58, there being notches (not shown) in the planar portions 72A, 73A to extend through when the side guides are in their adjacent positions.

Figure 4:
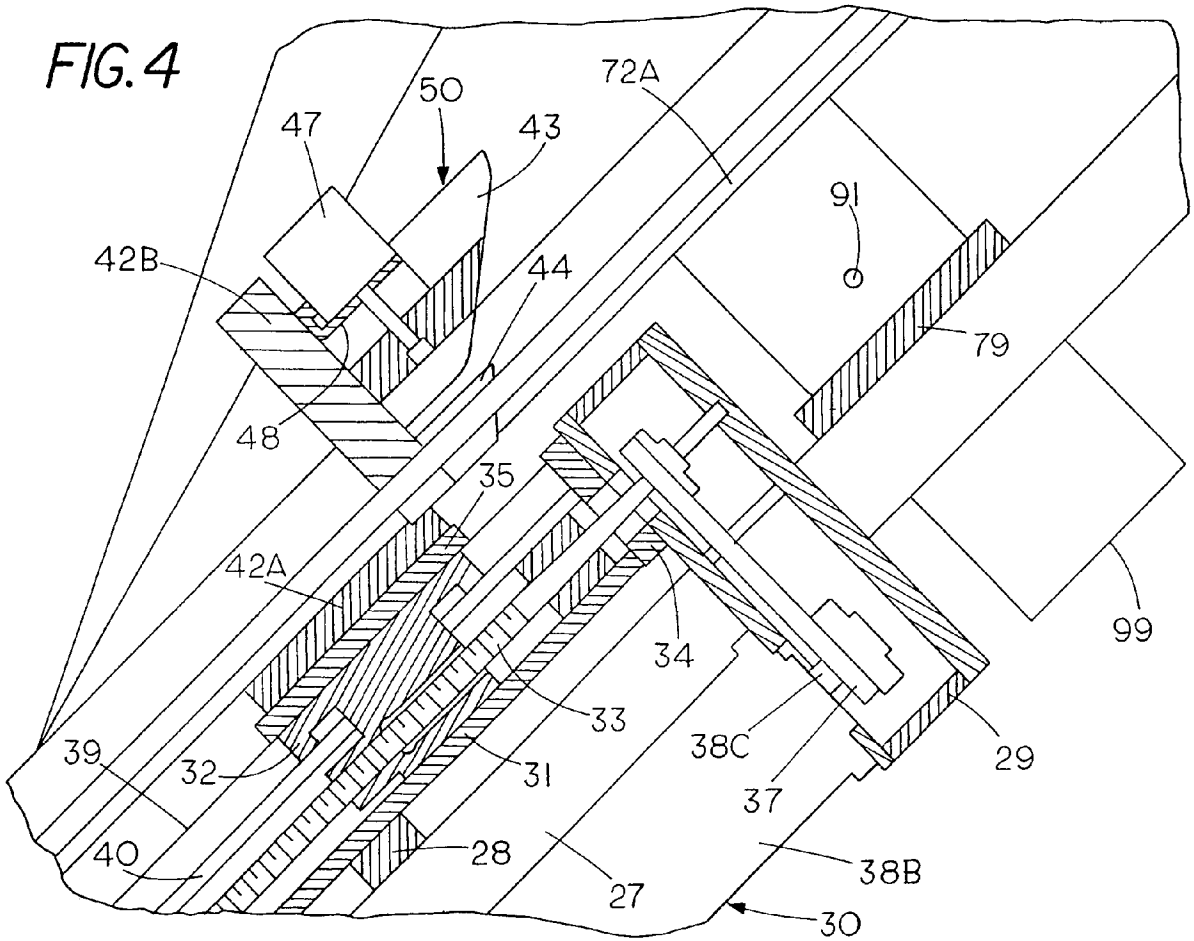
FIG. 4 is a fragmentary transverse cross sectional view of one the positioner trays assembly showing structure for transverse moving its bag bottom clamp, said view being generally taken along the line and in the direction of the arrows 4-4 of FIG. 2 other than the longitudinal actuator is not shown in cross section.
Figure 5:
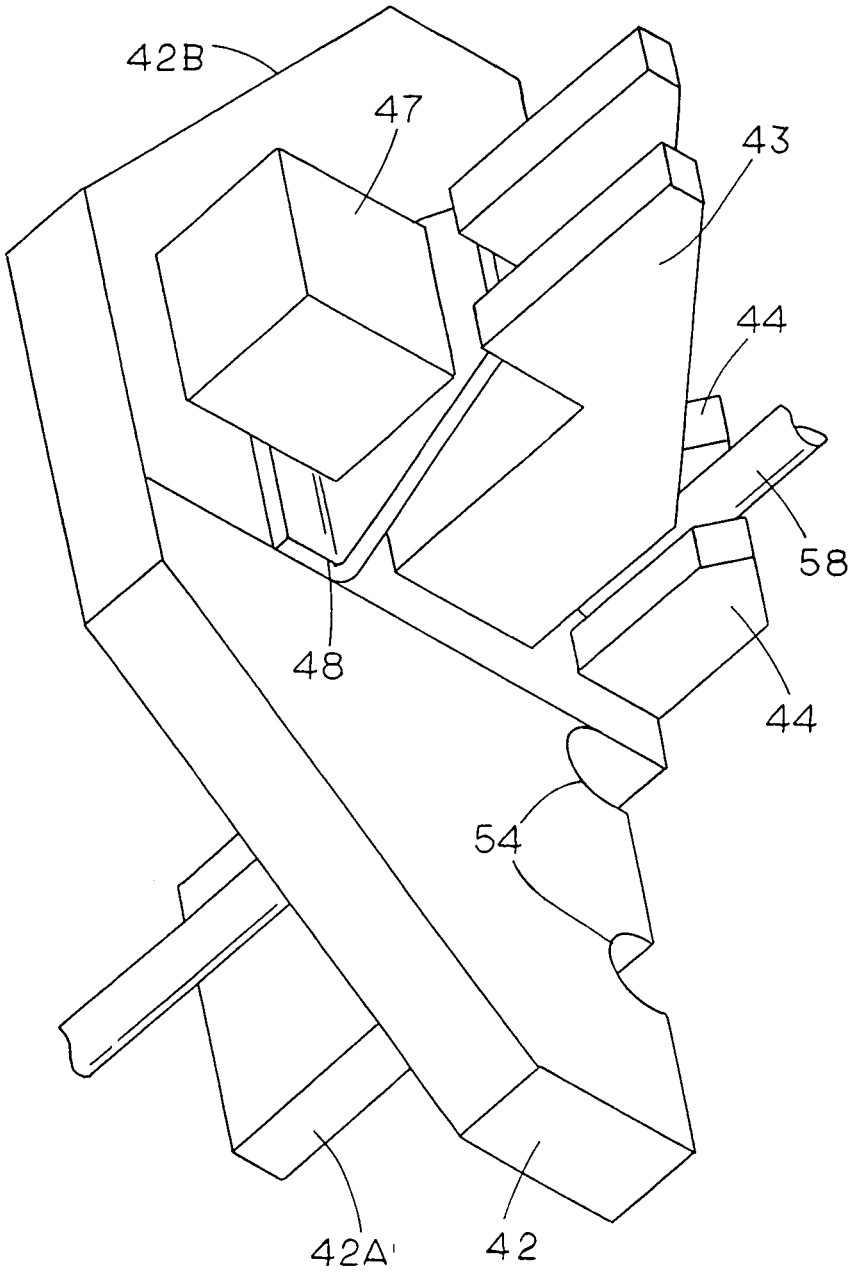
FIG. 5 is a perspective view of a bag bottom clamp.

Each tray positioner assembly also includes transversely spaced bars 28 mounted to the upper surfaces of the angle irons 27 which in turn mount a transversely inclined, elongated actuator, generally designated 30. Referring to FIG. 4, each actuator includes a housing 31 that for most of its length has an open top and a nut device 32 that is slideably movable therein by a linearly threaded screw 33 that is rotatably mounted to extend in the housing end walls 34. The nut device has a plate 35 secured thereto to move therewith and slide along the top edges 39 of the housing 31 while one or more guide rods 40 extend through the nut device to prevent rotation of the nut device while it moves within the housing 31. A casing 29 is mounted to housing 31 with a drive connection 37 being provided between the motor shaft 38C of the respective motor 38A, 38B and the screw 33.

Mounted to each positioner assembly plate 35 to move therewith is a plate 42A of the bag clamp mount 42 with the bag bottom clamps, generally designated 50A and 50B of assemblies G and H respectively, also see FIG. 4. Each clamp includes a pair of lower inclined clamp jaws 44 mounted to clamp mount portion 42B and an upper inclined clamp jaw 43 that is movable between a clamped position and a release position relative the lower jaws by a piston cylinder combination 47 that is mounted to mount 42 by a bracket 48.

Figure 2:
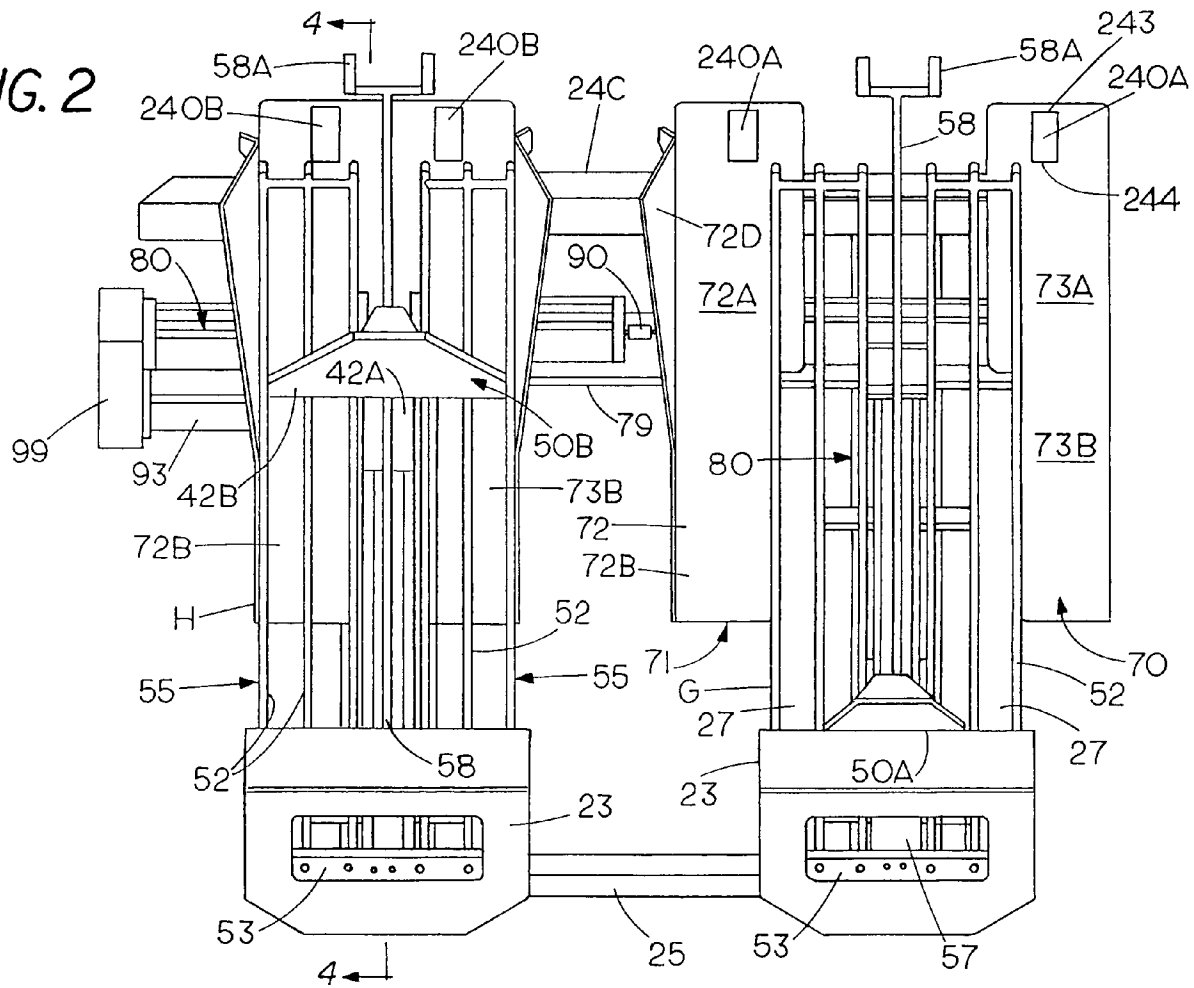
FIG. 2 is a vertical longitudinal view of the first and second positioner tray assemblies wherein one assembly is shown is shown in its spread apart (open) position while the other is shown in its together (closed) position even though during use the two assemblies are in substantially the same positions and some details are not shown.

Referring to FIG. 2, each positioner assembly includes a pair of bag trays, generally designated 55, that each, for example, includes 3 transversely elongated rods 52 that are longitudinally spaced with their lower ends mounted by a bar 53 which in turn is mounted by an angle iron to bracket 23. Adjacent the opposite end portion of the 3 rods, the middle rod being joined to the adjacent rods by cross rods. The adjacent two rods 52 of the two pairs extend through notches 54 in the bag clamp (not shown in FIG. 2) to extend above mount portion 42A and through the lower end portion 42B of the mount 42 be at or slightly above the top inclined surface of the lower jaw. It is noted said surface is shown at higher elevation than it actually is to facilitate the illustration thereof.

A block 57 is mounted to bar 53 and in turn mounts the lower inclined end of the center rod 58 with the rod extending through a notch 54 to extend to a higher inclined elevation than the two rod trays of the positioner assembly which are on the longitudinal opposite sides thereof. Each upper end of a center rod mounts longitudinally spaced fingers 58A that extend further transversely remote of the bag trays.

Figure 6A:
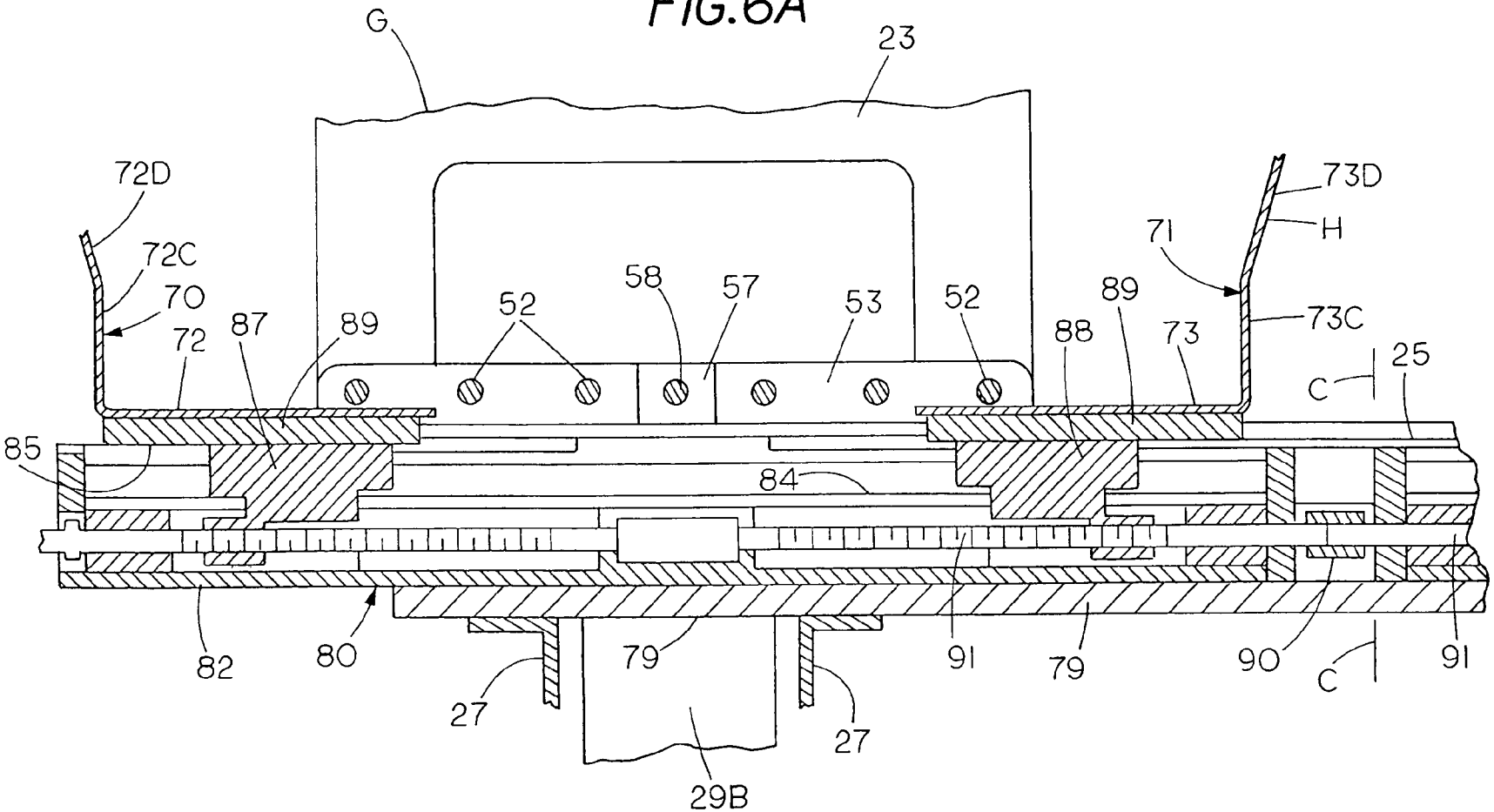
FIGS. 6A and 6B with lines C-C and D-D aligned is a fragmentary transverse cross sectional view of the positioner tray assemblies, said view being taken along the line and in the direction of arrows 6A, 6B of FIG. 1A with the assemblies being in the position of FIG. 2 and the positioner bag clamps not being shown.
Figure 6B:
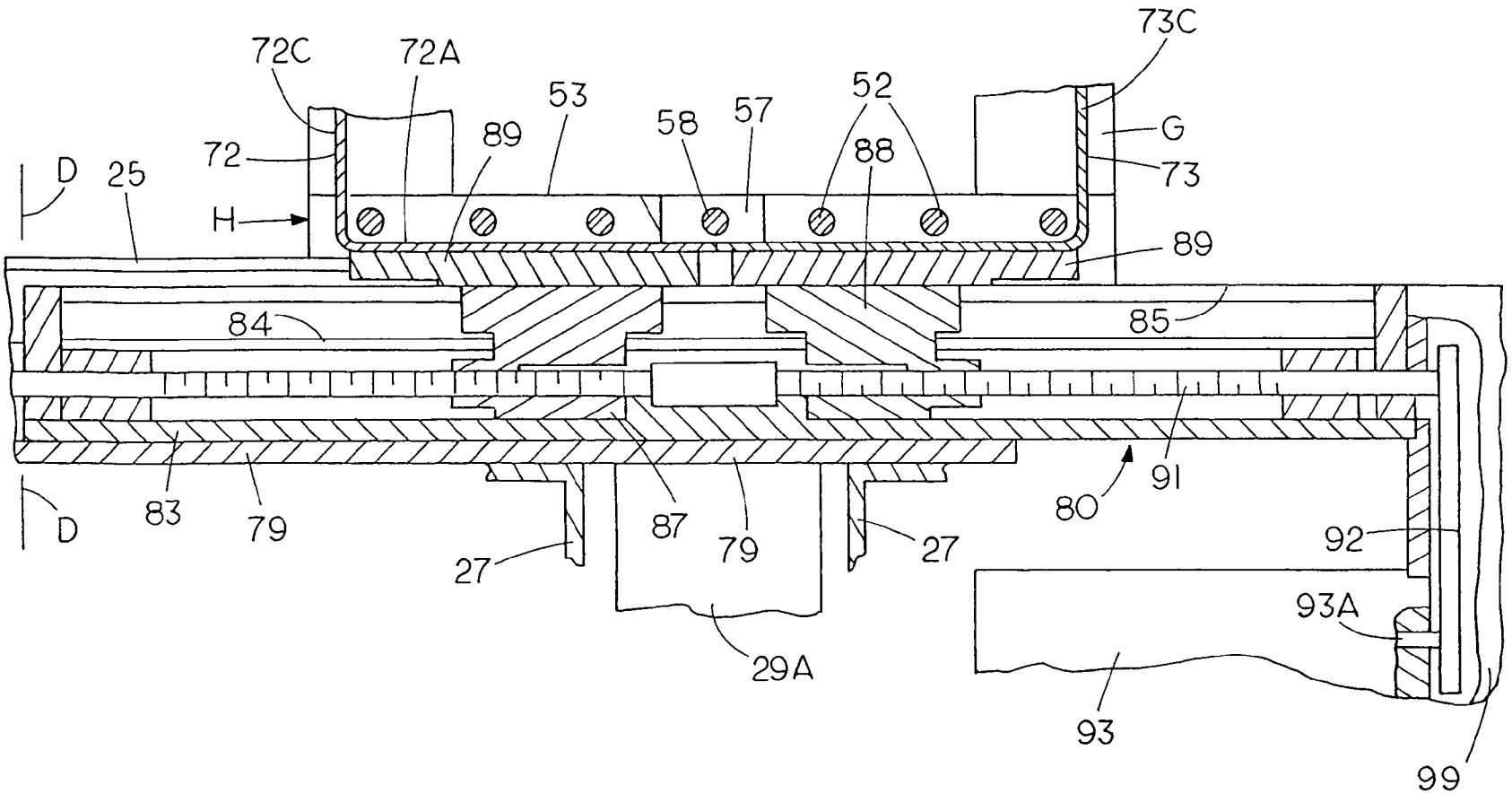

It is to be understood even though the side guide, generally designated 70, 71, are shown in FIG. 6A are shown in their adjacent (closed) position and those shown in FIG. 6B, they are shown in their spread apart (open) position, such has been done to facilitate the description and illustration of the positioner assemblies, it being understood during operation the side guides of each of positioner assemblies are either in their together positions are spread apart positions at the substantially same time. That is each positioner assembly also includes a pair of side guides 70, 71 with each guide including an inclined generally planar portion respectively that at their adjacent inclined longitudinal upper portions 72A, 73A are more closely adjacent one another and are of greater transverse dimensions than their transversely remote portions 72A, 72B. The remote transverse edges of portions 72A, 72B and 73A, 73B are parallel and are joined to wing portions 72C, 73C that at least initially extend at right angles to portions 72A, 73A respectively with portions of the wings 72D, 73D diverging upwardly and diverging away from one another at even greater angles along portions 72E, 73E. The major parts of portions 72A, 73A, 72B, 73B extend beneath the vertically adjacent parts of the bag trays in positioner assembly adjacent positions while the central part of mount portion 42A extends between the adjacent edges of portions 72B, 73B even when these portions are in their most closely adjacent positions and the bag clamp is in its uppermost inclined position. The upper inclined end portions of the tray rods may be downwardly curved.

For moving the side guides between their positions there are provided longitudinal spaced guide actuators, generally designated 80, 81, for positioner assemblies G, H respectively that are mounted on a longitudinally elongate plate 79 which in turn are mounted to the top surfaces of angle irons 27 to be in a position upwardly inclined from the actuators 30 (see FIGS. 6A, 6B). The guide actuators include housings 82, 83 each having slotted top 85 for having nut devices 87, 88 movably extended therethrough and each having one or more guide rods 184 mounted by the housing end walls and extended through the nut devices. Further each actuator 80, 81 includes a screw 91 that has oppositely linearly thread portions that are threadedly into the nut devices 87, 88 respectively so as the screw is rotated, the nut devices of each actuator are longitudinally moved in opposite directions to move the guides of each positioner assembly between their adjacent and spread apart positions. The screws are rotatably extended through the adjacent housing end walls and are rotatably connected together by a coupling 90. A drive connection 92 is provided between the motor shaft 93A of the motor 93 and screw 91 which extends within casing 99.

Each of the guides 70, 71 has its planar portions 72A, 73A mounted to a plate 89 to longitudinally move therewith while one plate 89 is mounted to nut device 87 and the other to nut device 88. The planar portions 72A, 73A are longitudinally slideable of over the angle iron 24C (see FIG. 9). The plates mount the planar portion of the side guides to be inclined to extend to at least in part beneath at least part of the tray racks.

The frame also includes a pair of top longitudinal frame members 93, 94 joined to the upper ends of vertical frame members 14, 17 respectively, a top transverse frame member 95 that are joined to the front ends of frame members 93, 94 and a longitudinally intermediate frame member 97 joined to frame members 93, 94.

Figure 7A:
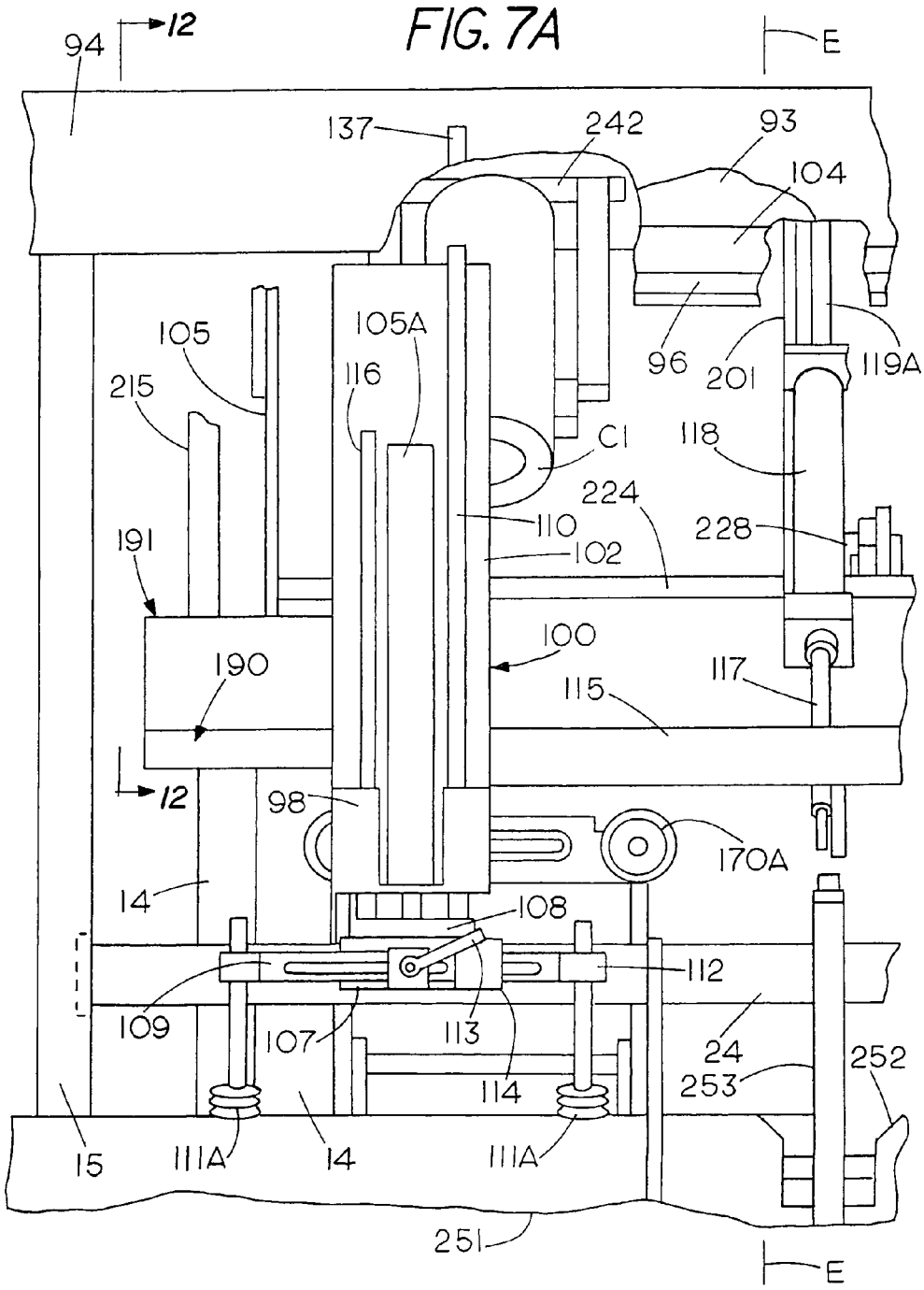
FIGS. 7A and 7B with lines E-E and F-F aligned is a fragmentary longitudinal view of the apparatus of this invention with the conveyor subassemblies being shown in block form in their FIG. 12 positions.
Figure 7B:
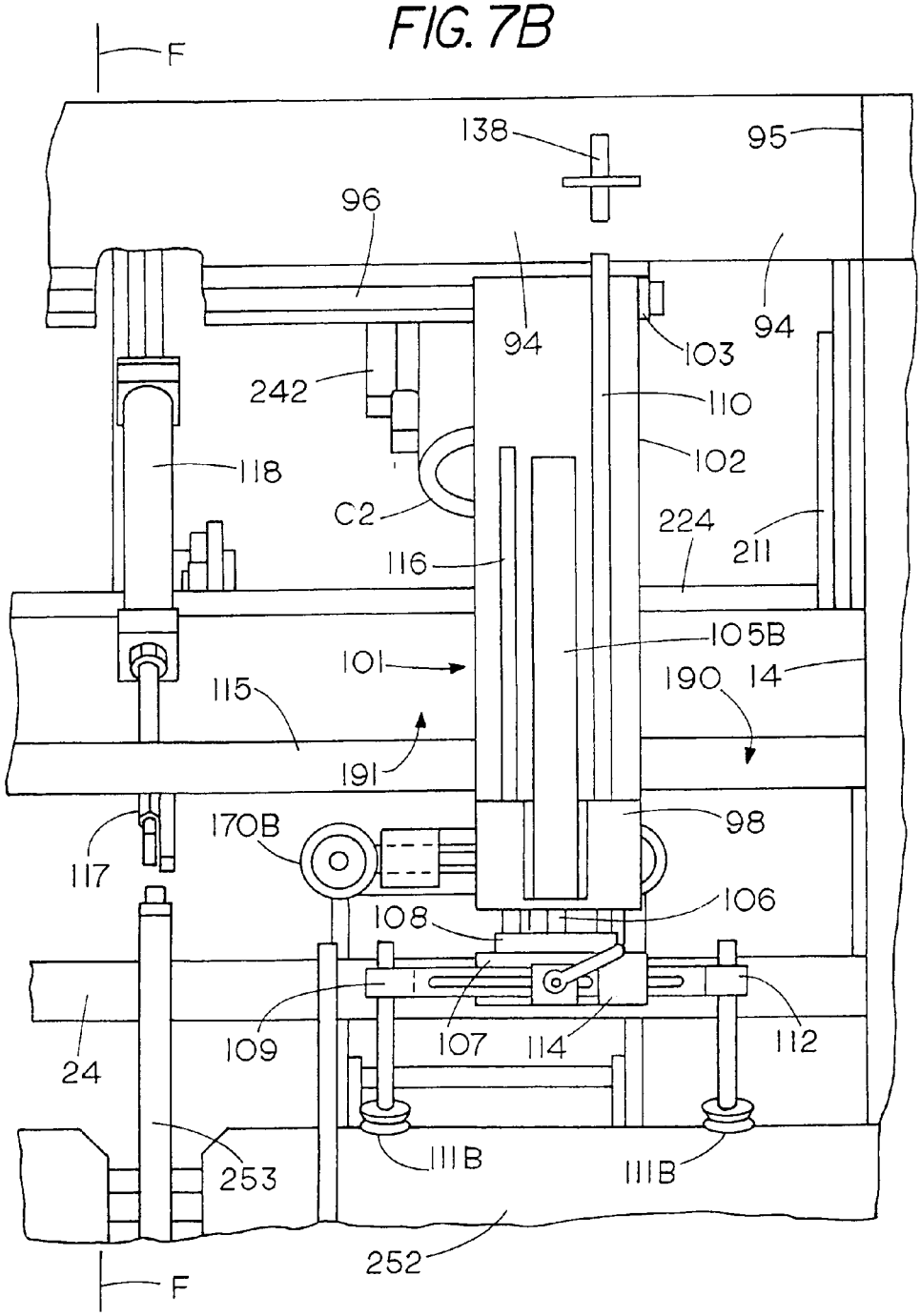

Referring in particular to FIGS. 1A, 7A and 7B, the infeed assembly X includes a pair of infeed subassemblies, generally designated 100 and 101, that are mounted in transverse spaced relationship and are of the same construction and therefor for the most part only one subassembly will be describe. Each subassembly includes a vertically elongated mounting plate 102 that at its upper end is pivotally mounted to pivot about a longitudinal pivot 96 by a pivot bracket 103 to a longitudinal plate 104 which in turn is dependingly joined to frame member 94. A mounting block 98 is mounted to the lower end portion of the mounting plate to in turn mount the cylinder 105A, 105B of the respective piston cylinder combination to have its piston rod 106 secured to a bar 108 for movement therewith. Guide rods 116, 110 are secured to a mounting bar 108 and slideably extended though block 98 to prevent rotation of the bar 108.

A bar 107 is mounted to bar 108 and on one transverse side mounts an adjustment bar 109 and on the opposite side mounts an adjustment bar 112, the adjustment bars being mounted for adjustable longitudinal movement to permit adjustable spacing of the vacuum cups 111A, 111B of the subassemblies 100, 101 respectively whose vertical valve stems are mounted to the respective bar for movement therewith. A handle device 113 extends through slots in the adjustment bars and into the bar 107 and is movable to retain the adjustment bars in an adjusted position and alternated to permit the adjustment bars being moved to change the longitudinal spacing of the vacuum cups 111A, 111B respectively. Guides 114 mounted to bar 107 retain the adjustment bars on the bar 107 and permit longitudinal movement relative to bar 107.

Referring to FIG. 1A, a longitudinal angle iron 115 is mounted to the mounting plates 102 adjacent their lower end portions while a piston rod 117 of a piston combination is pivotally mounted to mid-portion of the angle iron. The cylinder 118 of said combination is pivotally mounted to a bracket 119A which in turn is dependingly attached to the transverse mid-portion of frame member 97 whereby upon applying fluid under pressure to one end of the cylinder, the vacuum cups 111 are swung transversely outward and to the opposite end move inwardly to datum position of FIG. 1A, assuming the cups are in their upward position.

Figure 8:
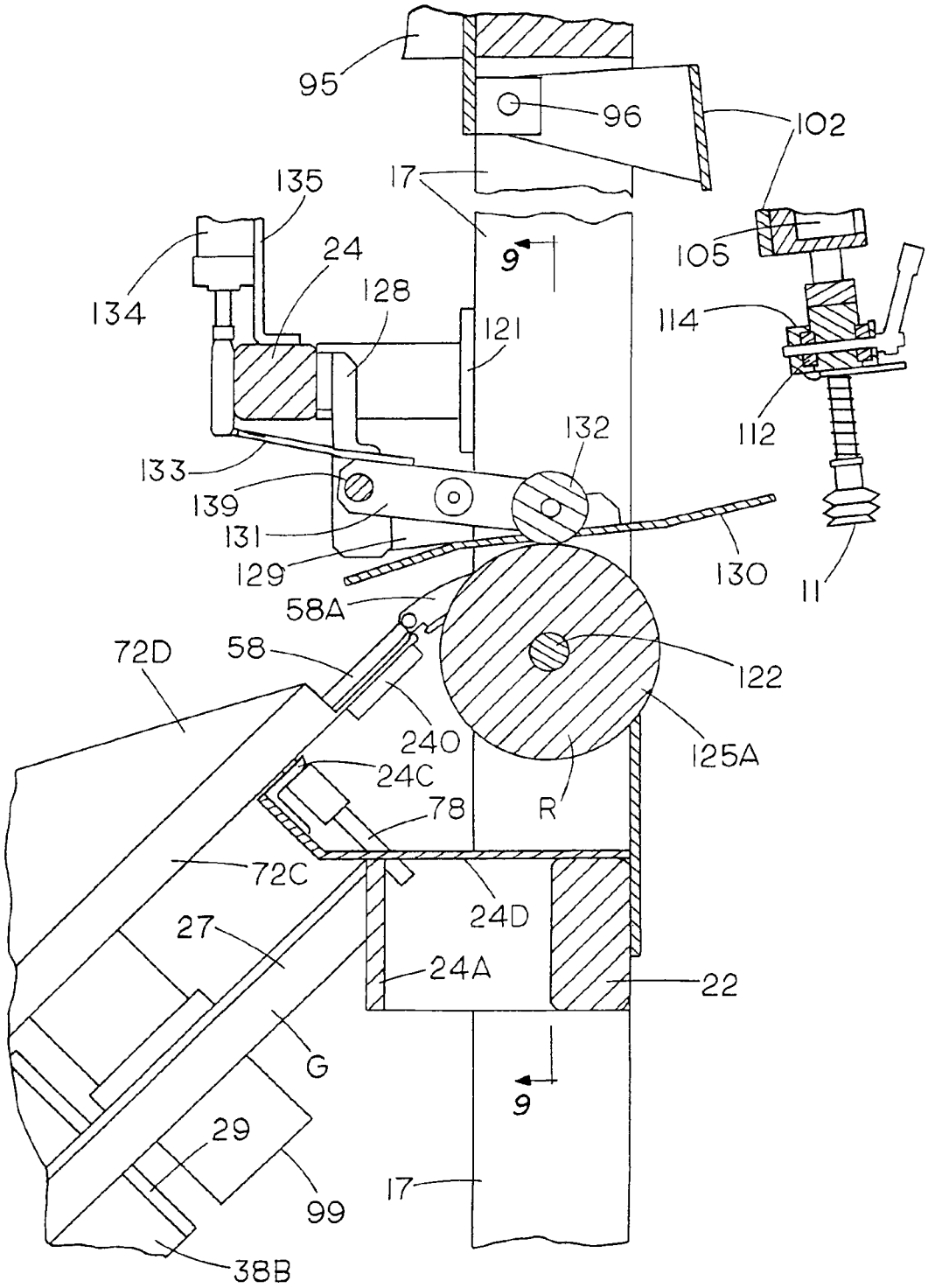
FIG. 8 is an enlarged fragmentary transverse cross sectional view of part of the infeed assembly, said view being generally taken alone the line and in the direction of the arrows 8-8 of FIG. 9 with the transversely adjacent part of the positioner tray assembly not being shown in section.
Figure 9:
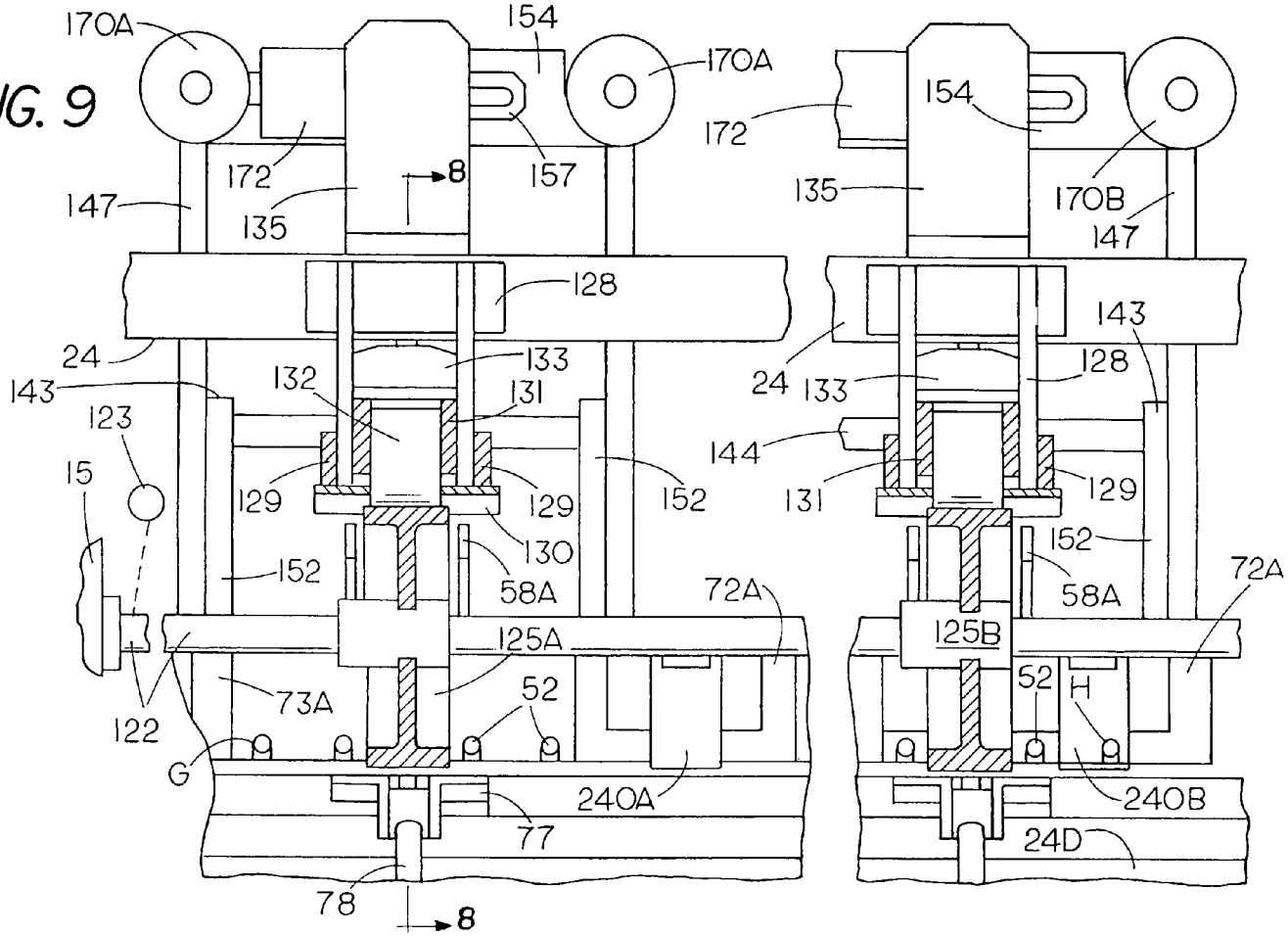
FIG. 9 is a fragmentary longitudinal view of part of the infeed assembly and the transverse part of the pick-up assembly that is generally taken along the line and the direction of the arrows 9-9 if FIG. 8.

Referring to FIGS. 8, 9 and 1A, feed roller mechanism R, is provided for receiving bags that have been removed from the magazine M by vacuum cups 111A. 111B and moving the bags to be deposited on the bag positioner assemblies. Mechanism R includes a longitudinal frame member 24 that at its opposite ends is mounted by brackets 121 to vertical frame members 15, 17. A feed roller shaft 122 extends longitudinally between and is rotatable mounted to frame members 15, 17 at an elevation vertically intermediate the positioner assemblies fingers 58A and the frame member 22. A motor 123 is drivenly connected to the shaft. Keyed to the shaft in longitudinal spaced relationship are a pair of feed rollers 125A, 125B to rotate therewith that are longitudinally aligned with the positioner assemblies H, G respectively.

Adjacent each roller 125A, 125B, there are a pair of brackets 128 mounted to the frame member 24 to depend therefrom. The lower end of each bracket mounts the one ends of transverse bars 129, the opposite ends of each pair of the bars 129 mounting a baffle 130 to extend above the respective feed roller and transversely on either side of the feed roller to direct a bag unto the bag trays to slide downwardly thereon. Further the brackets pivotally mount the one ends of bars 131 while the opposite ends rotatably mount an idler roller 132 to extend through a baffle slot to be abuttable against the adjacent feed roller. A strip 133 is mounted to the bars 131 transversely opposite the idler roller to extend away therefrom and pivot about pivot 139. The idler rollers are pivoted away from the adjacent feed roller upon the extension of the piston rod of the respective cylinder 134 which is mounted to the frame member 24 by a bracket 135.

Figure 3:
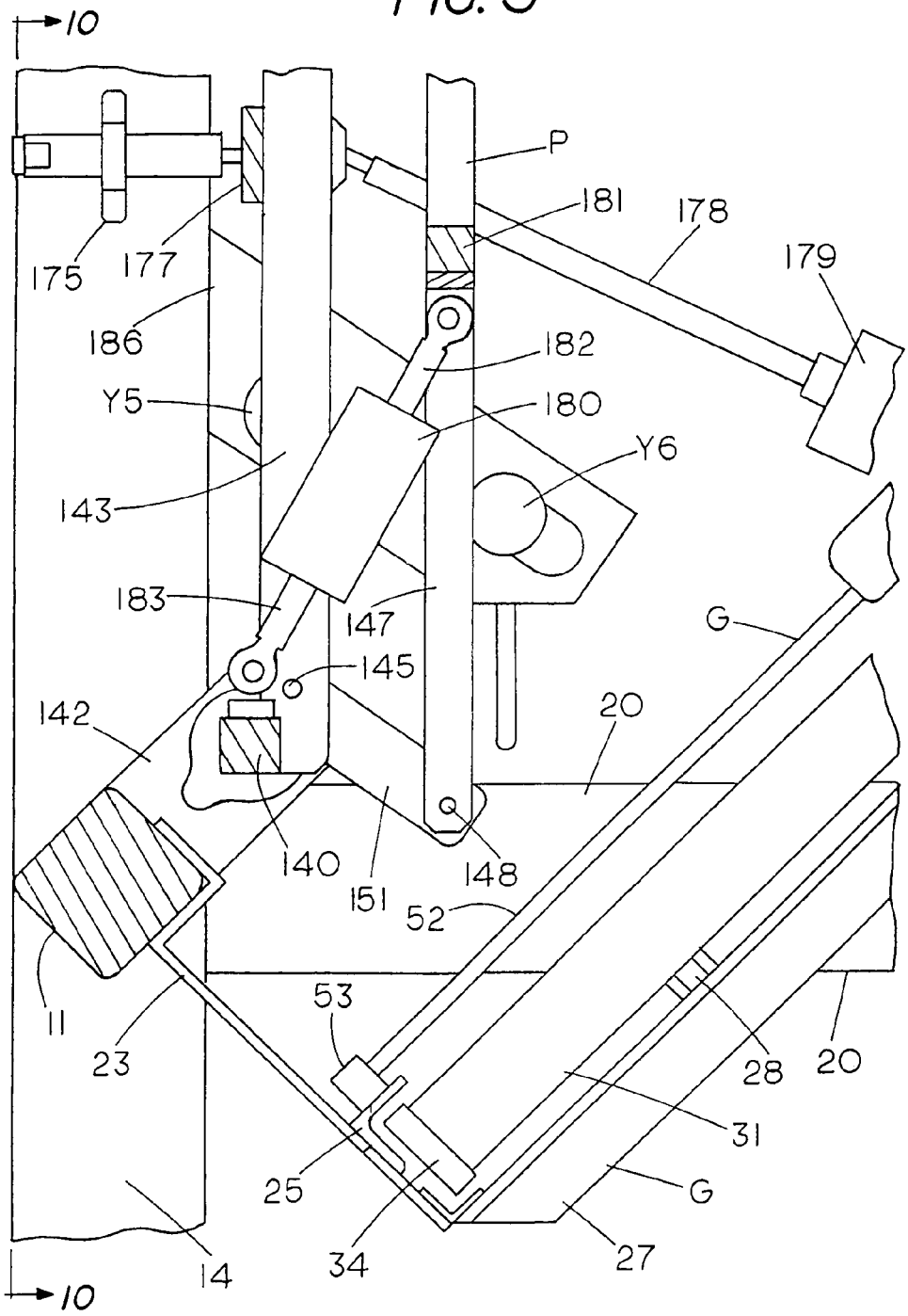
FIG. 3 is a fragmentary transverse view that is generally taken along the line and in the direction of the arrows 3-3 of FIG. 10.
Figure 10:
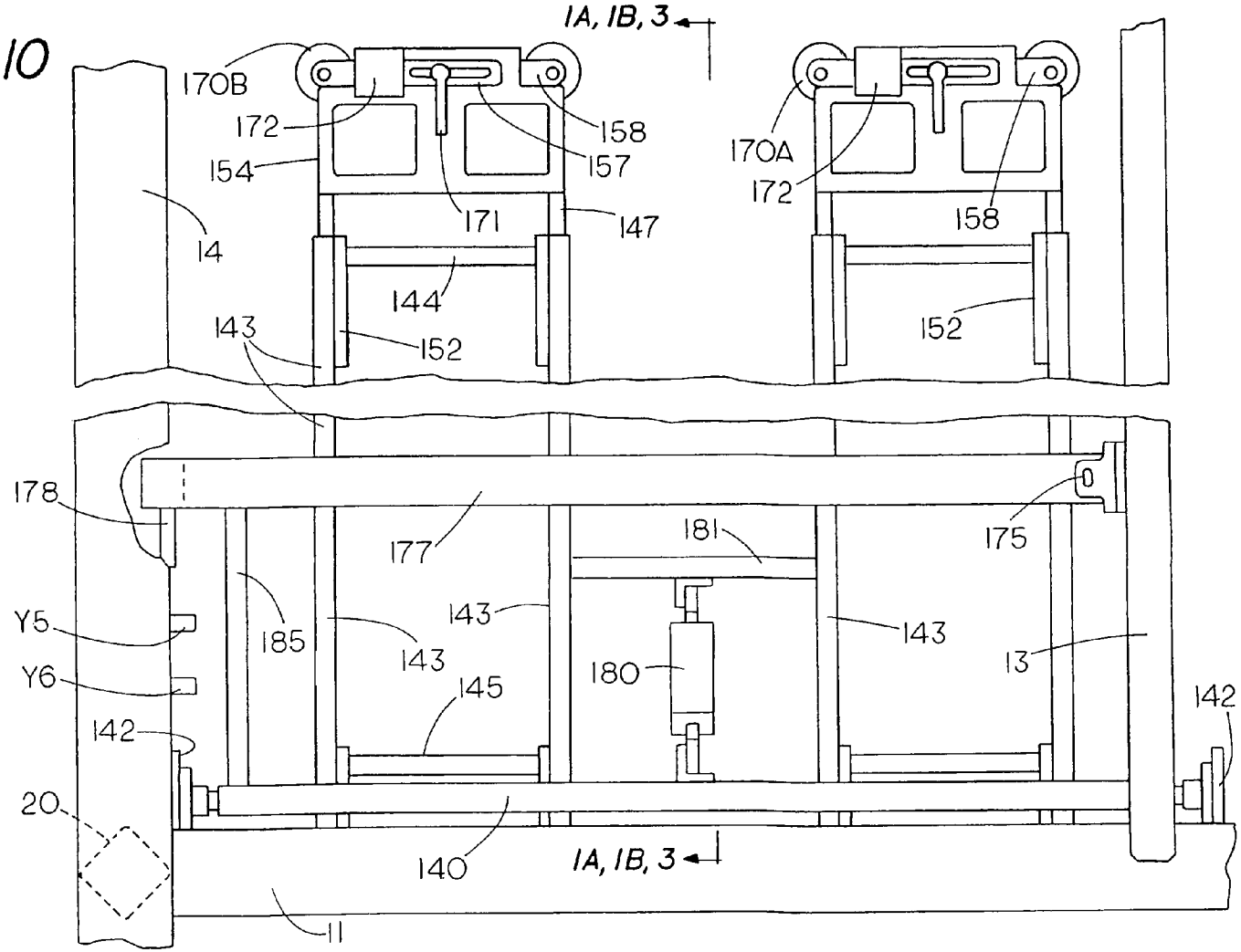
FIG. 10 is a vertical longitudinal view of the pick-up assembly in its datum position with portions broken away, said view being generally taken along the line and in the direction of the arrow 10-10 of FIG. 3.
Figure 11:
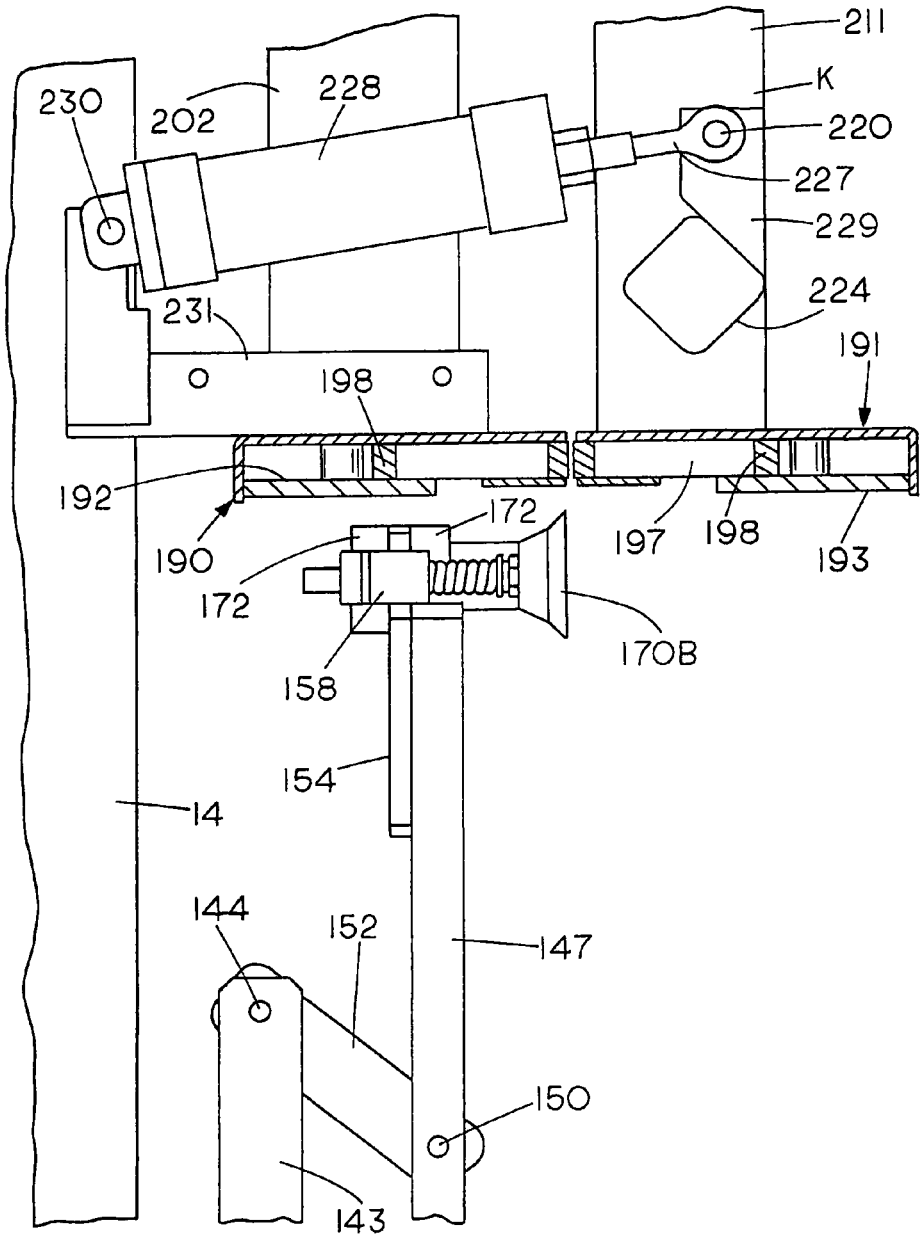
FIG. 11 is a fragmentary transverse cross sectional view of the conveyor assembly and the pick-up assembly with the conveyor assembly in its position for conveying a pick-up bag, said view being generally taken along the line and in the direction of the arrows 11-11 of FIG. 13 with the conveyor assembly being in its closed position.
Figure 12:
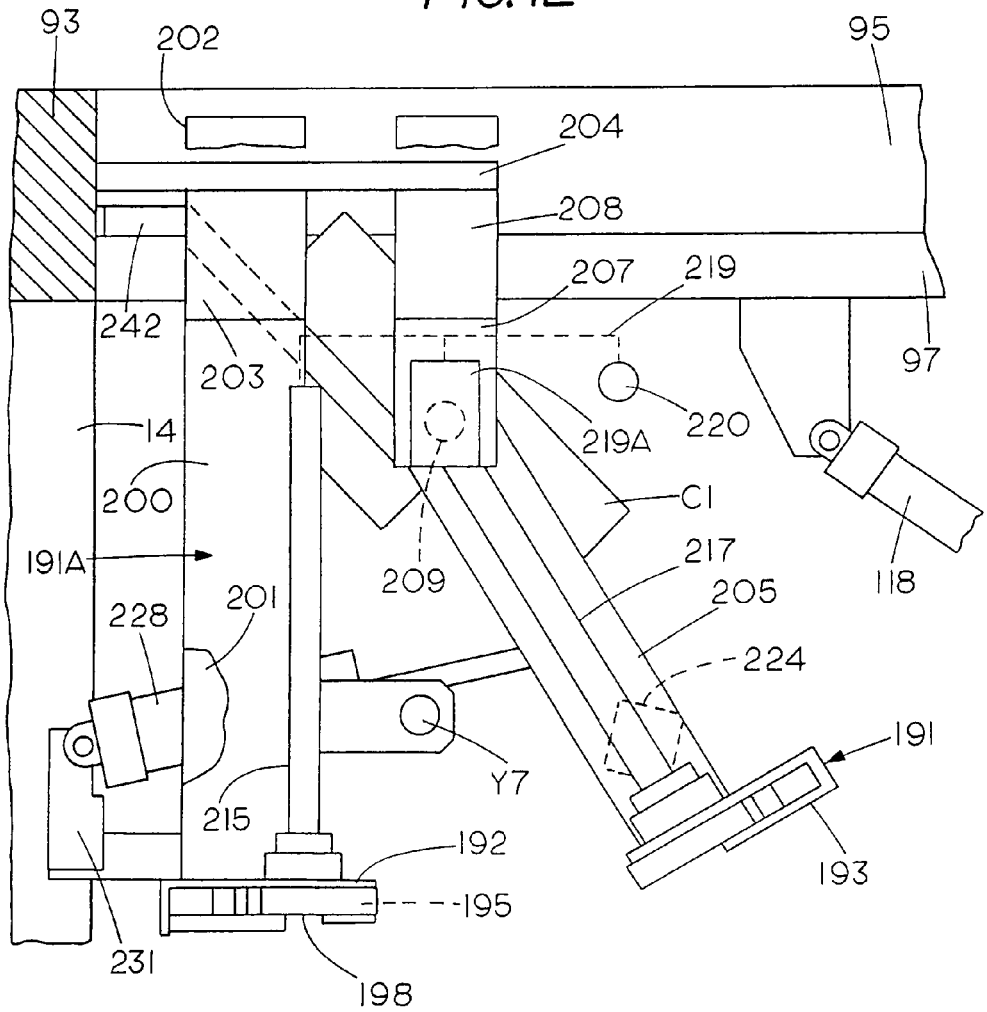
FIG. 12 is a fragmentary view of the conveying assembly in a spread apart (open) position for receiving a picked up bag; said view being generally taken along the line and in the direction of the arrows 12-12 of FIG. 7A.
Figure 13:
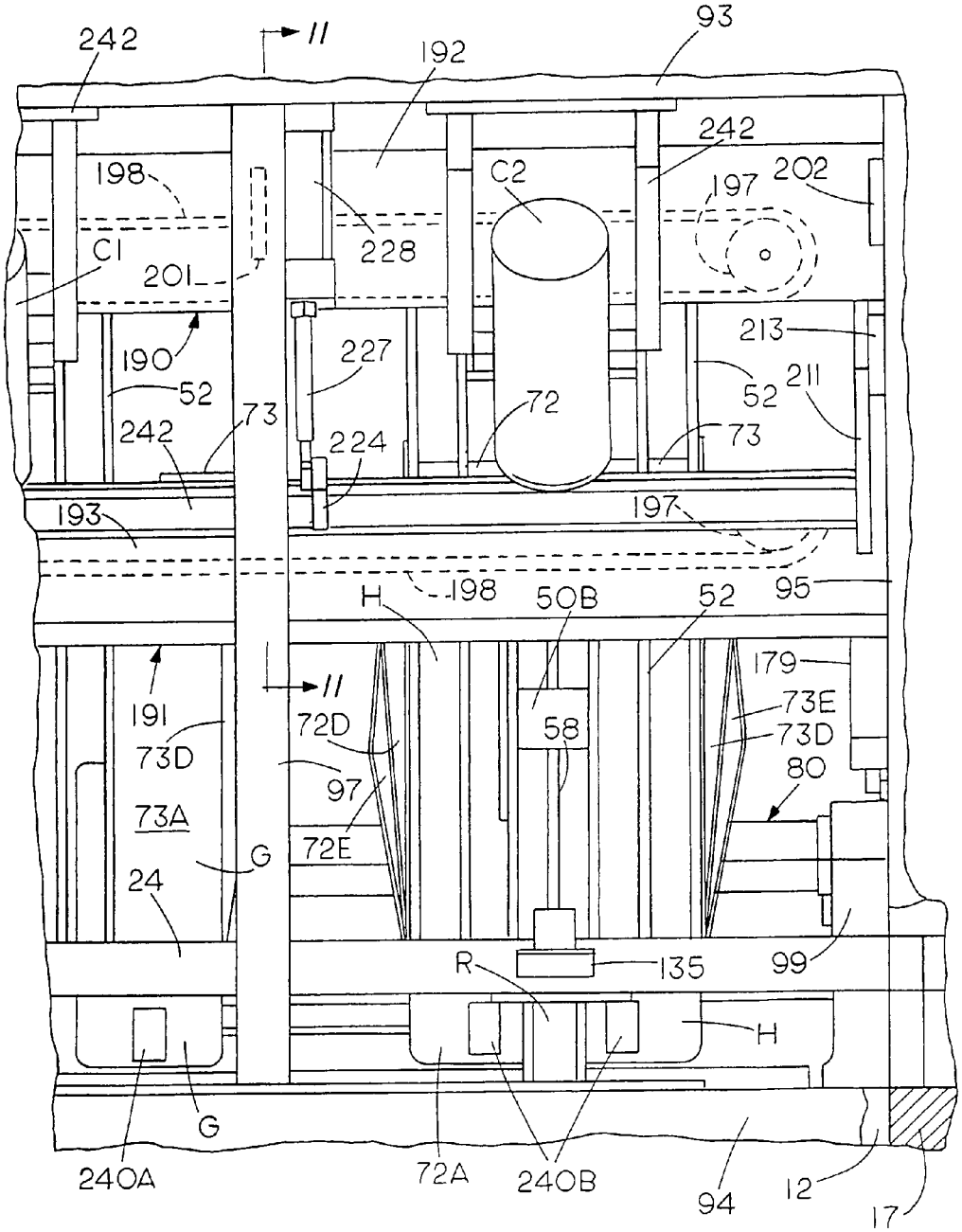
FIG. 13 is a fragmentary plan view of the apparatus of this invention with one of the clamps being represent by a rectangular box as is part of the infeed mechanism and parts of the infeed mechanism not being shown.

For removing the bags on each positioner assembly at the same time, the pick up assembly P includes a longitudinal shaft 140 that is pivotally mounted to frame member 11 by brackets 142 (see FIGS. 3, 10 and 11). For each positioner assembly, there are a pair of bars 143 that at their lower ends are fixed to the shaft 140 with their lower end portions mounting a longitudinal pivot member 145 while their opposite ends mount a longitudinal pivot member 144. Further, for each positioner assembly there is provide a pair of bars 147 that are connected that their one ends by a pivot member 148 and at their opposite ends by a pivot member 150. A pair of longitudinally spaced links 151 pivotally connect pivot member 145 to pivot member 148 while a pair of longitudinally spaced links 152 pivotally connect pivot member 144 to pivot member 150 to provide a parallel linkage.

The upper end portions of each pair of bars 147 mount a cup adjustment plate 154 with an adjustment bar 157 on transverse side and on the opposite side an adjustment bar 158, the adjustment bars being mounted for adjustable longitudinal movement to permit adjustable longitudinal spacing of the respective set of vacuum cups 170A, 170B whose vertical valve stems are mounted to the respective adjustment bar for movement therewith and slideably mounted for being resiliently retaining the cups a limited distance away from the respective bar. A handle device 171 extends through slots in the respective set of adjustment bars and into the plate 154 and is movable to retain the adjustment bars in an adjusted position and alternately to permit the adjustment bars being moved to change the longitudinal spacing of the vacuum cups 170A, 170B respectively. Guides 172 are mounted to plate 154 retain the adjustment bars on the plate 154 and permit longitudinal movement relative to plate 154.

A cross bar 177 is fixedly attached to the bars 143 and bars 147. A piston rod 178 of a piston cylinder combination 178, 179 is pivotally connected by a bracket 189 to one end of the cross bar while the cylinder 179 is pivotally connected to the mid-portion of frame member 20 a bracket 184 to move the vacuum cups between a position to pick up bags on the positioner assemblies and a position to transfer the bags to the conveyor assembly K. A shock absorber 175 is mounted to frame member 13 against which the cross bar may abut when the pick-up assembly moves the vacuum cups away from the positioner assemblies.

A cross bar 181 connects the adjacent bars 147 with piston rod 182 being pivotally connected to the cross bar, a second piston rod 183 being pivotally connected to frame member 140, there being a tandem cylinder 180 for selectively extending and retracting piston rods 182, 183. A bar 185 at its opposite ends is respectively mounted to a shaft 140 and cross bar 177. A bracket 186 mounts spaced sensors Y5, Y6 and is mounted to frame member 17 to respectively sense the movement of the bar 185 in its vertical up position and its down position.

Referring to FIGS. 1A and 11-13, the conveyor assembly K includes a stationary subassembly, generally designated 190, and a swingable subassembly, generally designated 191, both being longitudinally elongated for simultaneously receiving a pair of picked up bags (open position) and in a closed position of FIG. 11, conveyed the picked up bags to a position for further operations, for example opening and filling the bags. The subassemblies 190, 191 have longitudinally elongated belt mounts 192, 193 respectively which at their one ends mount driven sheaves 195 and at their opposite end mount idler sheaves 197. Each set of sheaves 195, 197 mount an endless belt 198 to have their adjacent runs in the subassemblies conveying position (FIG. 11) convey bags and with swing conveyor subassembly in its spread apart position (FIG. 12), have bag tops moved to a position for being conveyingly clamped therebetween. The mount 192 is secured to three longitudinally spaced vertical plates 200, 201, 202, plate 200 being mounted to a plate 203 that in turn is dependingly mounted to a bar 204 which is secured to frame member 93, plate 201 being dependingly mounted to frame member 97 and plate 202 being mounted to frame member 95. The mount 193 at one end portion is dependingly secured to a plate 205 that though plates 207, 208 is mounted to bar 204 with plate 205 being pivotally connected at 209 to plate 207. The opposite end portion of mount 193 is dependingly mounted to a plate 211 that is pivotally connected at 212 to plate 213 which in turn is mounted to frame member 95.

A drive shaft 215 is drivingly connected to sheave 195 of subassembly 190 while a drive shaft 217 is drivingly connected to the sheave 195 of subassembly 191. A conventional drive connection 218 between motor 220 and the shafts 215, 217 is represented by dotted lines 219 and box 219A in FIG. 12, the drive connection permitting shaft 217 to pivot about the common longitudinal axis of pivots 209, 212. In order to pivotally move the subassembly, a channel or beam 224 is connected to the plates 203, 211. The piston rod 227 of a piston cylinder combination 227, 228 is pivotally connected at 220 through a bracket 229 to the longitudinal mid-portion of beam 224 while the cylinder 228 is pivotally connected at 230 to a bracket 231 that is mounted to the belt mount 193. With the piston rod 227 being extended, the mount 193 is swung away from the mount 192. A sensor Y7 is mounted by a bracket 235 to plate 200.

The planar portions 72A, 73A of the side guides mounts back lights 240A, 240B respectively adjacent to the infeed roller 125A, 125B for each of the positioner assembles. Both of bag clamps are normally in positions that when a bag abuts against bag clamp portions 42B, the bag top portions will at least cover part of the back lights. When bags on the bag trays abut against the clamp portions 42B and their top edges are a preselected distance intermediate the longitudinal top and bottom edges 243, 244 respectively of the back lights, the bags are in positions when picked up and then clampingly held by the conveyor belts, the bag top edges will be at the same elevation even though the bags are of different lengths. Further, for each of the positioner assemblies, a camera C1, C2 is respectively mounted by a bracket 242 to frame member 93 and is aimed at the back lights 240A, 240B of the respective positioner, assembly. The cameras are blind to all light except that emitted by the back lights. As an example, but not otherwise a limitation on the present invention, the cameras are COGNEX ISM1020-00, the lens may be from EDMUNDS OPTICS part number 58-001 and the back lights are ADVANCED ILLUMINATION part number EL 19303-660-24-005.

Referring to FIG. 14, the magazine mechanism M is somewhat diagrammatically shown and is of a conventional tandem type that does not form a part of this invention and will only partial described. The mechanism includes a generally longitudinal vertical wall portions 251, 252 adjacent the infeed subassemblies 100, 101 respectively and a transverse divider wall portion 253. The upper run of a conveyor belt 254 progressively conveys stacks of horizontal, flat folded bags B1 in the directions of arrows 255 to a position to have one stack in position to have the top bag picked by the vacuum cups 111A of subassembly 100 while the upper run of a conveyor belt 257 conveys a stack of bags B2 in the direction of arrows 258 to a position to have the top bag stack B2 picked up by the vacuum cups of subassembly 101. The bags may be of paper or poly material with or without conventional zipper type closures. The bags are conveyed with their closed ends (bag bottoms) 259 adjacent to the respective wall portion 252, 253 and their bag mouths 270 remote from the wall portions 251. The bags may be of the same lengths, however for purposes of more easily describing the operation of the invention, the bags 271, 272, 273, 274 in each stack are shown of progressively longer lengths L. However, it is to be understood that in each stack, the uppermost bag may be the same, or a shorter length, or of a longer length, than the bag immediately therebeneath and correspondingly the same applies to each successive bag that is further remote from the top bag. When all the bags of a stack beneath the respective set of vacuum cups, through conventional controls (not shown) the relevant conveyor belt move a second stack to be in position to be in place to be picked up the set of cups that have removed the last bag from the stack that was previously therebeneath.

Figure 15A:
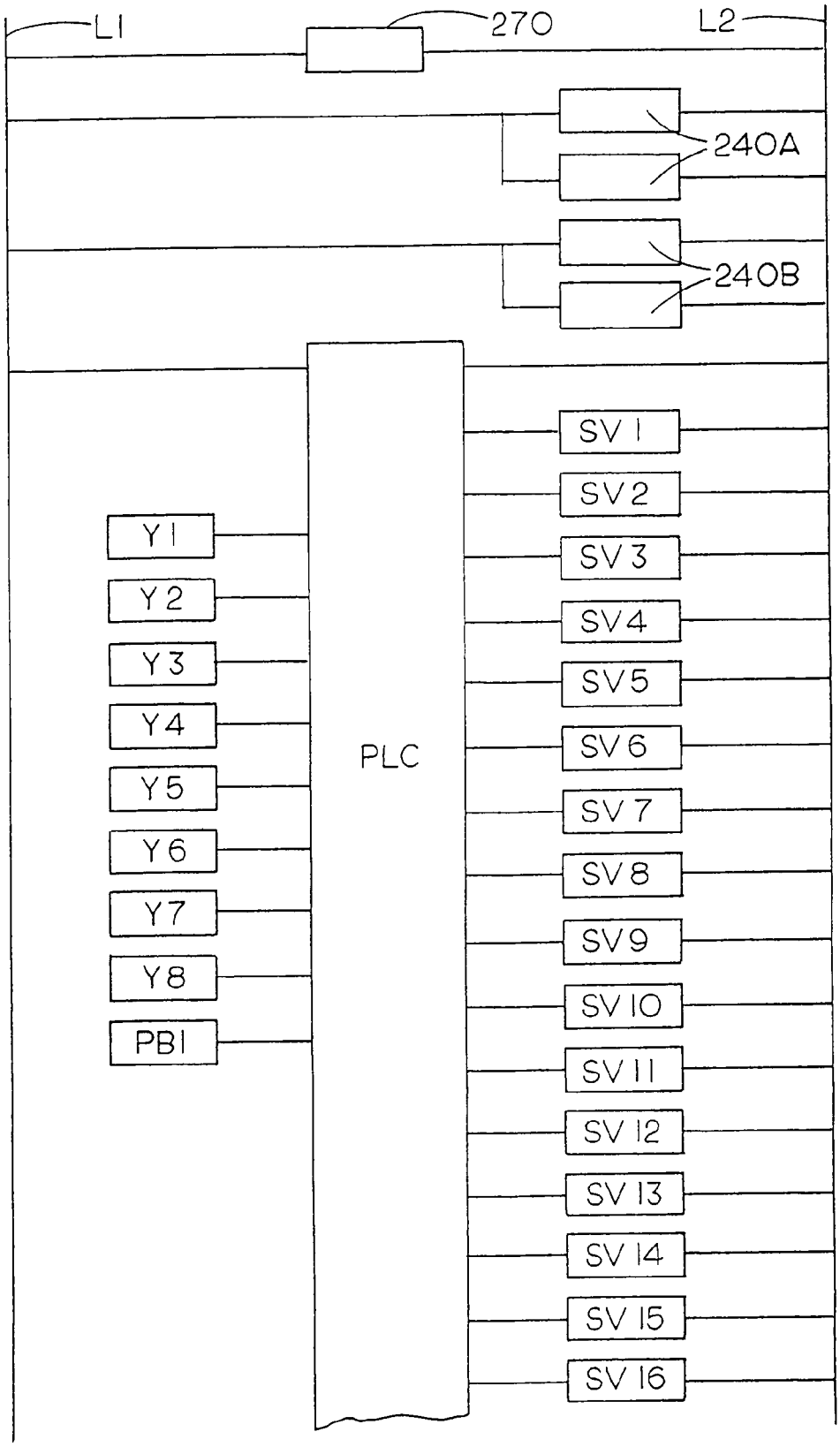
FIGS. 15A and 15B are a schematic showing of control mechanism.
Figure 15B:
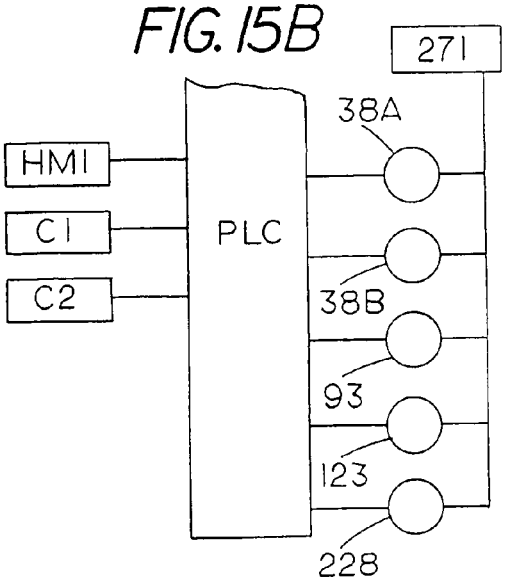
Figure 16:
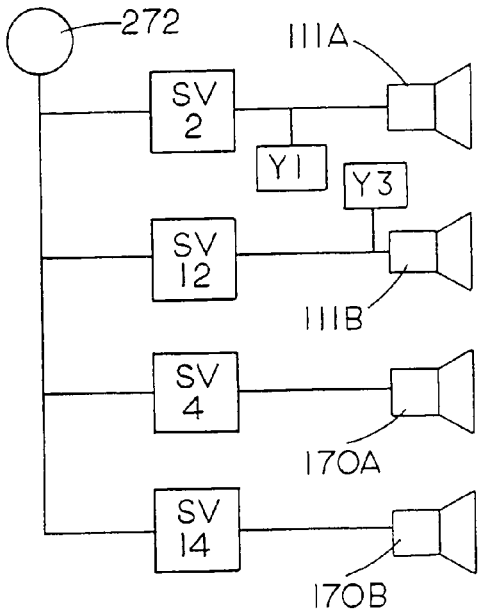
FIG. 16 is schematic showing of the circuitry for applying vacuum to the vacuum cups.
Figure 17:
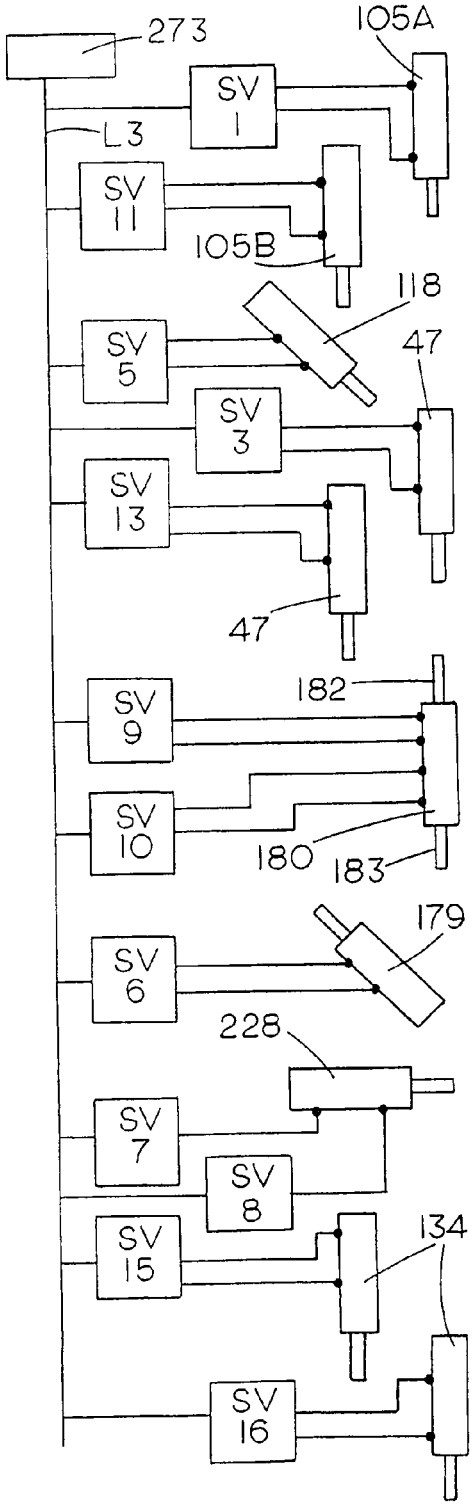
FIG. 17 is a schematic showing of circuitry for applying pressurized fluid to the piston cylinder combinations.

Referring to FIGS. 15A and 15B, a low voltage source 270 and a programmable logic controller (PLC) are connected in parallel across lines L1, L2. The PLC controls the energization and the de-energization of the solenoid valves. Further the back lights 240A, 240B are connected to lines L1, L2 to be energized thereby. A human-machine interface (HMI) is connected to the PLC for manipulating and the sequence of operations controlled by the PLC. A main line L3 is connected to a high voltage source 271 while motors 38A, 38B, 93 and 123 are connected between line L3 and the PLC.

A solenoid valve SV2 is fluidly connected between vacuum cups 111A and a vacuum source 272 with a vacuum sensor Y1 being in the line between the solenoid valve and vacuum cups while a solenoid valve SV 12 is fluidly connected between the vacuum cups 111B with a vacuum sensor Y3 being in the line between valve SV 12 and cups 111B. Further, solenoid valves SV 4 and SV 14 are fluidly connected between vacuum cups 170A and 170B respectively and the vacuum source.

A solenoid valve SV1 is fluidly connected between a pressurized fluid source 273 and cylinder 105A, a solenoid valve SV 11 is fluidly connected between the fluid source and cylinder 105B while a solenoid valve SV 5 is fluidly connected between the fluid source and cylinder 118. Further, a solenoid valve SV3 is fluidly connected between the fluid source and cylinder 47 of the positioner assembly G and a solenoid valve SV 13 is fluidly connected between the cylinder 47 of the positioner assembly H and the fluid source. Additionally solenoid valves SV 15 and 16 are fluidly connected to the source 273, with one being fluidly connected to one of the cylinders 134 and the other to the other cylinder 134.

A solenoid valve SV 9 is fluidly connected between the fluid source 273 and the cylinder 180 for controlling the extension and retraction of the piston rod 182 while a solenoid valve SV 10 is fluidly connected between the fluid source and the cylinder 180 for controlling the extension and retraction of the piston rod 183. The solenoid valve SV 9 and SV 10 are of type that when energized, the respective piston rod is moved to one of its positions and when de-energized, the respective piston rod is moved to its opposite position. A solenoid valve SV 6 is fluidly connected to the cylinder 179. The solenoid valves SV1, SV3, SV 5, SV 6, SV 11, SV 13, SV15 and SV 16 are of convention type that when energized, connects fluid under pressure to one ends of the respective cylinder and when de-energized to the opposite end.

A solenoid valve SV 8 is fluidly connected between the fluid source and one end of cylinder 228 that when energized, moves conveyor subassembly 191 to its closed position and SV 7 is fluidly connected between the fluid source and the opposite end of the cylinder that when energized, moves the conveyor subassembly to its open position.

In use, the operator inputs to the PLC, the empty bag length, empty bag width, registration position and bag feed off timer (not shown) of the PLC by the HMI. When stacks of horizontally flat empty bags on the magazine mechanism in positions to be picked up by the infeed subassemblies 100, 101, the push button PB1 is pushed which indicates the apparatus of this invention is running. The PLC sends the empty bag width to motor 93 to open the side guides for accepting empty bags. Further, the PLC sends the empty bag lengths to the motors 38A, 38B to move the bag clamps to their lower inclined positions for accepting empty bags.

The "start bagfeed" (not shown) is pushed and the PLC energizes valves SV1, SV 11 to respectively lower vacuum cups 111A, 111B down unto the respective stack of bags and energizes vales SV 2 and SV 12 to apply a vacuum to cups 111A and 111B. Upon the cups 111A and 111B vacuumly gripping the bags, the respective sensor Y1 and Y3 results in the PLC de-energizing valves SV 1 and SV 11 whereupon the piston rods of cylinders 105A and 105B retract vacuum cups 111A and 111B with the bag that was the tops on the stacks B1 and B2. When both of the sensors 137 and 138 sense that the guide rods 110 and 110 are up and according the vacuum cups 111A and 111B are up, the PLC starts the bag infeed vacuum off timer of the PLC (not shown) and the bag length timer of the PLC (not shown) and energizes the valve SV 5 to swing the cups 111A and 111B toward the infeed rollers 125A and 125B respectively and the solenoid valves SV 15 and SV 16 are energized whereby the idler rollers are raised above the respective infeed roller to facilitate the movement of bags therebetween and thence de-energized to lower the idler roller into contact with the adjacent bag. When the bag feed timer vacuum off timer has timed out, the valves SV 2 and 12 are de-energized to discontinue the application of vacuum to the cups 111A and 111B. Thence the motor 93 is energize whereupon the idler rollers in combination of infeed rollers 125A and 125B feed the bags unto the trays of positioner assembly to side down to abut against the open bag bottom clamps 50A and 50B.

When the bag length timer is 90 percent done, the PLC signals the motor 93 to move the side guides toward one another to the preselected width and thereby centering the bags on the positioner assembly trays. When the bag length timer times out, the PLC triggers the cameras C1 and C2 to take pictures of the portion of the bags that extend over part of the respective sets of back lights 240A and 240B, the cameras being perpendicular to the respective set of back lights. For each set of back lights, the distance from the top of one of the back lights, for example 240A to the top of the bag on the tray and the distance from the top of the other back light of the same positioner assembly is sent to the PLC and calculates the correction distance between the average of these distance and the registration position is sent to the respective motor, for example motor 38A. The PLC energizes the solenoid valves SV3 and SV13 to operate the bag clamps to clamp the respective bag and sends the correction distances to motors 38A and 38B respectively. These motors moves the respective bag and signals the PLC that the bags are in the proper positions on the bag trays so that when the bags are subsequently conveyed for further operations, the bag top edges are at the same elevation even though the bags are not of the same lengths L.

When the bags are in their proper positions on the bag trays, the PLC de-energizes the solenoid valves SV 3 and 13 whereupon the bag holder clamps move to their release positions. Also the PLC energizes valve SV4 and 14 which applies a vacuum to vacuum cups 170A, 170B, SV6 which results in the pick-up assembly P pivoting from its up position of FIG. 1A to a down position its vacuum cups 170A, 170B are engagable with bags on the bag trays of positioner assemblies G, H, solenoid valve SV9 which results in piston 182 being extended to move cups 170A, 170B to their pick position and valve SV 7 which results in the conveyor subassemblies being in their open position of FIG. 12.

When the sensor Y6 senses the picker assembly P is down, the solenoid SV 6 is de-energize which results in the picker assembly P being moved to its up position of FIG. 3 and the solenoid valve SV 10 being energized results in the piston rod 183 being extended to move the picker assembly vacuum cups to a place position to be at an elevation that the bag tops can be clampingly conveyed by the conveyor subassemblies 190, 191. When the sensor Y5 senses the pick-up assembly is in its up position, solenoid valve SV 7 is de-energized and valve SV 8 is energized to move the conveyor subassembly to its closed position to conveyingly engage the bag tops on the pick-up assembly. When the sensor Y7 senses the conveyor subassembly is in its closed position, solenoid valves SV 4 and 14 are de-energized to discontinue the application of vacuum to the cups 170A and 17OB and valves SV 9 and 10 are de-energized so that piston rods 182 and 183 retract the pick-up assembly cups away from the bags that are to be conveying engaged by the conveyor subassemblies. Then the PLC sends a signal to motor 228 to convey the bags to a place for further operations and the bag has been transferred for further operations, the motor is de-energized as well as solenoid valve SV 8.

When the bags is removed from the positioner subassemblies, the PLC controls the operation so that the motors 38A and 38B return the guides back to their spread apart positions, the bag holder clamps to the inclined positions they were in prior to infeed bags sliding down the bag trays, and move the infeed vacuum cups 105A and 105B away from the infeed rolls and down to pick up another pair of bags from the magazine mechanism M whereupon the cycle of operation is repeated.

What is claimed is:

1. Bag top registration apparatus for removing bags from a supply of flat folded bags having bag bottoms and bag top portions with bag top edges that may be of different lengths from the bag bottoms to the bag top edges and subsequently transferring bags with their bag top edges at the same elevation for further operations, comprising:

a frame having longitudinal and transverse dimensions, first means for supporting a bag in an inclined position with its bag bottom at a lower elevation than its bag top portion, the first means having a lower end portion and an upper end portion in transverse spaced relationship to the lower end portion, means for mounting the first means on the frame at an angle of inclination that a bag in being moved thereunto will slide downwardly toward the lower end portion, operable bag clamps for clamping engaging the bag bottom of a bag on the first means and transverse moving the bag on the support means and releasing the clamped bag when its bag top edge is at a preselected registration position on the first means, operable means for moving the bag clamps with a clamped bag to have its bag top edge at the registration position if not already in said registration position and subsequently releasing the clamped bag, infeed means mounted to the frame removing a bag from a magazine and feeding it to the first means to slide downwardly with its bag bottom more closely adjacent to the bag clamp means than its bag top edge portion, a conveyor assembly on the frame that is operable between a first position for receiving a flat folded bag at a given position with its bag top edge at a preselected elevation and a second position for conveying the bag away from a position it was received while retaining its bag top edge at said preselected, elevation, operable pick-up means on the frame for transferring a bag that has its bag top edge at the registration position and has been released by the clamp means to the conveyor assembly with its bag top edge at said preselected elevation and control means for automatically sensing the position of the bag top edge of each of the individual bags on the first means and automatically operating the operable means to clamp a bag on the first means and automatically moving the clamp to move the individual bag that is on the first means, if necessary, to have its bag top edge at the registration position, thence the operable clamp means to release the clamped bag and thereafter the pick-up means for transferring the bag to the conveyor assembly.

2. The bag top registration apparatus of claim 1 wherein the means for moving the clamp means includes a housing, a transversely elongated, inclined linearly threaded screw rotatably mounted to the housing, a servo motor for rotating the screw and means mounted by the housing to move the clamp means as the screw is rotated.

3. The bag top registration apparatus of claim 2 wherein there is a back light on the positioner assembly that is blind to all light other than that emitted by the back light, a camera aimed at the back light for acquiring an image of the top edge of a bag on the positioner assembly relative to the back light and the control means includes means for comparing image of the bag top edge with the registration position and in response thereto control the operable means for moving the clamp means to move the bag to have its bag top edge at the registration position, if not already in said registration position.

4. The bag top registration apparatus of claim 1 wherein the control means includes a first back light mounted to the first means upper end portion, a first camera aimed at the back light that is blind to all light other than that emitted by the back light for acquiring an image of the top edge relative to the back light and means for comparing the image of where the bag top edge is and a preselected registration position relative to the back light and if necessary operate the bag clamp moving means for moving the bag clamp means in clamping relationship to the bag to move the bag to a position its bag top is at the registration position.

5. The bag top registration apparatus of claim 4 wherein the means for comparing the image includes a programmable logic controller that receives an image of the bag top portion from the camera and calculates the length of the bag on the bag support means and compares it with the preselected registration position to obtain a correction distance and then controls the movement of the bag clamp operable mean to move the bag clamp in its clamping position whereby the bag is moved to its registration position and a human machine interface for imparting to the programmable logic controller the bag length and bag width, and the preselected registration position.

6. The bag top registration apparatus of claim 4 wherein the control means includes a programmable logic controller that receives an image of the bag top portion from the camera and calculates the length of the bag on the first means and compare it with the preselected registration position to obtain a correction distance and then controls the movement of the bag clamp operable mean to move the bag clamp means in its clamping position whereby the bag is moved to its registration position and actuates the operable pick-up mean for transferring the bag to the conveyor assembly and human machine interface for imparting to the programmable logic controller the bag length and bag width, and the preselected registration position.

7. The bag top registration apparatus of claim 6 wherein the first means includes first and second transversely elongated side guide member that are longitudinally movable relative to one another between a spread apart position and a closed position and each having the first means upper end portion and actuator means operable in response to the programmable logic controller for moving the guide means to center the bag on the guide members as the bag is feed onto the first means, the first back light being mounted to the first guide member upper end portion and a second back light is mounted to the second guide member upper end portion, each back light having a longitudinal top edge and a longitudinal bottom edge and the camera aimed at the second back light for acquiring an image of the top edge relative to the second back light, the programmable logic controller comparing the image of where the bag top edges are relative to a preselected registration positions intermediate to the back lights top and bottom edge and, if necessary, operate the bag clamp moving means for moving the bag clamp means in clamping relationship to the bag to move the bag to a position its bag top is in the registration position.

* * * * *